US007340790B2

(12) United States Patent
Aouad et al.

(10) Patent No.: US 7,340,790 B2
(45) Date of Patent: Mar. 11, 2008

(54) UNIVERSAL DISPENSER FOR DISPENSING OF LAUNDRY ADDITIVES DURING AUTOMATIC MACHINE LAUNDERING OF FABRICS

(75) Inventors: Yousef Georges Aouad, Cincinnati, OH (US); Liben Hailu, Cincinnati, OH (US); Terence Graham Curtis, Flackwell Heath (GB); Lawrence Joseph Kelly, Fairfield, OH (US); William Wayne Wichman, Cincinnati, OH (US); Jonathan Norman Robert Hodges, Windsor (GB)

(73) Assignee: Procter & Gamble Company, Cincinnati, OH (US)

( * ) Notice: Subject to any disclaimer, the term of this patent is extended or adjusted under 35 U.S.C. 154(b) by 696 days.

(21) Appl. No.: 10/777,240

(22) Filed: Feb. 12, 2004

(65) Prior Publication Data

US 2005/0102767 A1 May 19, 2005

Related U.S. Application Data

(63) Continuation-in-part of application No. 10/737,429, filed on Dec. 16, 2003, and a continuation-in-part of application No. 10/366,204, filed on Feb. 13, 2003, now Pat. No. 7,036,177, and a continuation-in-part of application No. 10/366,100, filed on Feb. 13, 2003, now Pat. No. 7,036,176, and a continuation-in-part of application No. 10/289,936, filed on Nov. 7, 2002, now Pat. No. 7,168,273.

(60) Provisional application No. 60/526,642, filed on Dec. 3, 2003, provisional application No. 60/435,646, filed on Dec. 20, 2002, provisional application No. 60/356,544, filed on Dec. 13, 2002, provisional application No. 60/356,543, filed on Feb. 13, 2002.

(51) Int. Cl.
*D06F 39/02* (2006.01)

(52) U.S. Cl. ..... 8/158; 68/17 R; 68/207

(58) Field of Classification Search ..... 134/93; 68/17 R, 207
See application file for complete search history.

(56) References Cited

U.S. PATENT DOCUMENTS 3,812,273 A * 5/1974 Schmidt ..... 426/433

(Continued)

FOREIGN PATENT DOCUMENTS

CA 1 133 712 10/1982

(Continued)

*Primary Examiner*—Frankie L. Stinson
(74) *Attorney, Agent, or Firm*—Julia A. Glazer; Julie A. McConihay; Kim William Zerby

(57) ABSTRACT

Disclosed are systems, methods, devices and kits for dispensing laundry additive materials into the drum of an automatic washing machine as that machine is used to carry out a fabric laundering operation. To bring about such dispensing of additives, a lidded housing structure is placed within the drum of an automatic washing machine, an insert, containing one or more laundry additives in each compartment, is placed within the lidded housing structure, the lid is closed and the machine is run through the several stages of its laundering cycle. Selectively actuatable puncturing element are provided to optionally open at least one compartment of the insert upon closing of the housing structure lid, thereby dispensing the contents of that opened compartment into the washing machine drum as wash additive materials and/or to open one or more compartments of the insert later in the laundering cycle to dispense contents of those compartments into the washing machine drum as rinse additive materials. The selectively actuatable puncturing element being activated by centrifugal force arising during the spin cycle of the laundering operation. In a multiple rinse cycle laundering operation, selectively actuatable puncturing element has a track and cam that allows for the dispensing of additives into the desired rinse cycle.

25 Claims, 10 Drawing Sheets

U.S. PATENT DOCUMENTS

| | | | | |
|---|---|---|---|---|
| 3,988,908 | A | | 11/1976 | Beare et al. |
| 4,026,131 | A | | 5/1977 | Dugger et al. |
| 4,186,573 | A | | 2/1980 | Brenner et al. |
| 4,260,054 | A | | 4/1981 | Bory et al. |
| 4,265,372 | A | | 5/1981 | Wainberg |
| 4,379,515 | A | | 4/1983 | Towsend |
| 4,416,791 | A | | 11/1983 | Haq |
| 4,429,812 | A | | 2/1984 | Steiner et al. |
| 4,588,080 | A | | 5/1986 | Ginn |
| 4,696,615 | A | * | 9/1987 | Ettischer et al. ..... 414/795.8 |
| 4,700,857 | A | | 10/1987 | Kittscher, et al. |
| 4,882,917 | A | | 11/1989 | Mizusawa et al. |
| 4,982,467 | A | | 1/1991 | Mizusawa et al. |
| 5,033,643 | A | | 7/1991 | Schumacher |
| 5,061,807 | A | | 10/1991 | Gethöffer et al. |
| 5,129,120 | A | | 7/1992 | Cornette et al. |
| 5,133,487 | A | | 7/1992 | Russi |
| 5,176,297 | A | | 1/1993 | Mooney et al. |
| 5,488,447 | A | * | 1/1996 | Patton et al. ..... 396/578 |
| 5,536,421 | A | | 7/1996 | Hartman, et al. |
| 5,613,824 | A | * | 3/1997 | Kato ..... 414/412 |
| 5,687,588 | A | | 11/1997 | Azzani, et al. |
| 5,732,853 | A | | 3/1998 | Ganzeboom et al. |
| 5,792,219 | A | | 8/1998 | Hartman et al. |
| 6,138,693 | A | | 10/2000 | Matz |
| 6,179,167 | B1 | | 1/2001 | Boot et al. |
| 6,203,535 | B1 | | 3/2001 | Barney et al. |
| 6,220,267 | B1 | * | 4/2001 | Joshi ..... 137/9 |
| 6,281,183 | B1 | | 8/2001 | Harbour |
| 6,352,158 | B1 | | 3/2002 | Cole-Bennett et al. |
| 6,378,274 | B1 | | 4/2002 | Harbour |
| 6,439,387 | B1 | | 8/2002 | Bergman |
| 2002/0049846 | A1 | | 4/2002 | Guzzi, et al. |
| 2002/0078589 | A1 | | 6/2002 | Hagemann, et al. |
| 2002/0088502 | A1 | | 7/2002 | Van Rompuy, et al. |
| 2002/0100773 | A1 | | 8/2002 | Rodd et al. |
| 2002/0108969 | A1 | | 8/2002 | Rodd et al. |
| 2003/0172960 | A1 | | 9/2003 | Aouad, et al. |
| 2003/0172961 | A1 | | 9/2003 | Aouad, et al. |
| 2003/0182732 | A1 | | 10/2003 | Davenet, et al. |
| 2004/0088796 | A1 | | 5/2004 | Neergaard, et al. |

FOREIGN PATENT DOCUMENTS

| | | | | |
|---|---|---|---|---|
| DE | 39 22 342 | | | 1/1991 |
| DE | 39 34 123 | | | 4/1991 |
| DE | 101 14 256 | A1 | | 3/2001 |
| DE | 199 45 849 | | | 3/2001 |
| DE | 101 14 256 | | * | 10/2002 |
| EP | 0 351 671 | | | 7/1989 |
| EP | 1 195 350 | | | 4/2002 |
| WO | WO 94/07979 | | | 4/1994 |
| WO | WO 96/26312 | | | 8/1996 |
| WO | WO 97/09480 | | | 3/1997 |
| WO | WO 00/02982 | | | 1/2000 |
| WO | WO 00/02987 | | | 1/2000 |
| WO | WO 00/29537 | | | 5/2000 |
| WO | WO 00/49218 | | | 8/2000 |
| WO | WO 01/07702 | | | 2/2001 |
| WO | WO 01/07703 | | | 2/2001 |
| WO | WO 01/07704 | | | 2/2001 |
| WO | WO 01/16271 | | | 3/2001 |
| WO | WO 01/23295 | | | 4/2001 |
| WO | WO 01/25526 | | | 4/2001 |
| WO | WO 01/25527 | | | 4/2001 |
| WO | WO 03/069042 | | | 8/2003 |
| WO | WO 03/069043 | | | 8/2003 |
| WO | WO 2004/044303 | A1 | | 5/2004 |
| ZA | 9800086 | | * | 9/1998 |

* cited by examiner

UNIVERSAL DISPENSER FOR DISPENSING OF LAUNDRY ADDITIVES DURING AUTOMATIC MACHINE LAUNDERING OF FABRICS

CROSS REFERENCE TO RELATED APPLICATIONS

This application claims the benefit of: provisional application U.S. Ser. No. 60/526,642 filed Dec. 3, 2003 and is a continuation-in-part of: U.S. Ser. No. 10/366,204, filed Feb. 13, 2003 which claims the benefit of provisional application U.S. Ser. No. 60/356,544, filed Feb. 13, 2002; U.S. Ser. No. 10/366,100, filed Feb. 13, 2003 which claims the benefit of provisional application U.S. Ser. No. 60/356,543, filed Feb. 13, 2002; U.S. Ser. No. 10/289,936, filed Nov. 7, 2002; and U.S. Ser. No. 10/737,429, filed Dec. 16, 2003 which claims the benefit of provisional application U.S. Ser. No. 60/435,646, filed Dec. 20, 2002.

TECHNICAL FIELD

The present invention relates to systems, methods and devices for adding separate laundry additive materials to the drum (tub) of an automatic fabric laundering (washing) machine during its cycle of operation. The separate laundry additive materials themselves are packaged in a cartridge or insert or other unit dose form which is inserted into a holder device within the washing machine drum in order to effect selective dispensing of the materials into the drum during the wash and/or rinse cycle.

BACKGROUND OF THE INVENTION

There are many types of laundry additive materials suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The several types of laundry additive materials described hereinbefore, frequently intermingled or admixed together in a wide variety of combinations for convenience, are commonly marketed to consumers in bulk quantities, in either solid, i.e., granular or tablet, or liquid form. To carry out the laundering operation, the consumer then adds aliquots of product as needed or desired from the bulk products into the automatic washing machine drum in appropriate amounts and at appropriate times during the laundering cycle.

It would be desirable, and a number of attempts have been made, to market fabric laundering products in "unit dose" form whereby aliquots of combinations of laundry additive materials are provided in pre-measured, pre-packaged form.

The consumer can then conveniently add one of these unit dose aliquots to the automatic washing machine, e.g., into the drum, at the beginning of the laundry cycle and not have to measure product from bulk or add product to the cycle at different subsequent points in time.

Several factors complicate the provision of multiple types of laundry additive materials in unit dose form. In the first place, many types and forms of laundry additives are not compatible with each other within a single concentrated product. Different types of materials may chemically interact with each other when admixed in concentrated form, thereby degrading and rendering one or both types ultimately ineffective for its intended purpose. Such incompatibility works against combining such materials together within a single unit dose product.

Secondly, during the laundering cycle itself, different types of laundry additives work best under different conditions which occur as the laundering operation progresses through its cycle which generally includes washing and one or more rinsing stages within the drum. It therefore becomes advantageous to add different types of laundry additives to the washing machine drum at different times during the laundering cycle. This timed or staged addition of separate, distinct materials to the automatic washing machine drum is also difficult to accomplish with product packaged in unit dose form.

Given the foregoing difficulties in formulating unit dose products for use in fabric laundering operations carried out in a multi-cycle, drum-containing automatic washing machine, it would be desirable to provide a system which can effectively utilize laundry additive products in unit dose form to deliver a variety of ingredients to the drum of an automatic fabric laundering machine during its operational cycle. This is realized by providing a unit dose in the form of a package having one or more compartments that is placed into a housing unit that is positioned within the washing machine drum and which serves to bring about selective dispensing of laundry additives from the one or more compartment(s) of the insert.

SUMMARY OF THE INVENTION

In its system aspects, the present invention is directed to an arrangement of mechanical elements which provides for the dispensing of laundry additive materials into one or more stages of the laundering cycle which occur during the operation of a drum-containing automatic fabric laundering machine. Such an arrangement comprises a housing positioned within the washing machine drum, an insert which can be placed within the housing having one or more compartments that contain the laundry additive materials to be dispensed into the washing machine drum, and at least one selectively actuatable puncturing element for opening the compartments of the insert at one or more points is the laundering cycle.

The housing structure is positioned within the automatic washing machine. This housing includes a base which can hold the insert and a closable lid for this base. The insert can be placed within the housing at the beginning of the laundering operation. In one embodiment the insert contains at least two different laundry additive materials within at least two different compartments. These different laundry additive materials are added to the contents of the washing machine drum at different points in the laundering cycle.

In one embodiment, the housing structure has one or more selectively actuatable puncturing elements associated with it which serves to open at least a first compartment of the insert. In one embodiment the puncturing element may effect opening of the insert upon closing the lid of the housing structure after the insert has been positioned within the housing structure or later in the laundry cycle. The opening of these first compartment(s) upon closing the lid permits the dispensing of the contents of the opened compartment(s) into the washing machine drum at the beginning of the washing cycle.

In another embodiment the system includes a selectively actuatable puncturing element associated with either the housing or with the insert or with both to open one or more compartments of the insert later in the laundry cycle. In a more particular embodiment such additional compartment(s) generally contain laundry additive material(s) which is/are different from that in at least one of the previously opened compartments of the insert. The opening of these additional compartments is not effected when the lid is closed but is effected by the centrifugal force generated during a spin cycle. The opening of the additional compartment(s) of the insert permits the dispensing of the compartment contents into the washing machine drum at one or more stages following the first spin cycle.

In yet another embodiment of the invention, the selectively actuatable puncturing element includes a cam follower and a cam track such that the additives may be optionally but selectively released into the desired laundry cycle by means of the cam and track configuration later in the laundering operation.

In its method aspects, the present invention relates to the method of using the system described hereinbefore to bring about the dispensing of laundry additive materials into one or more stages of the laundering cycle during the operation of a drum-containing automatic washing machine for fabric laundering. Such a method comprises first positioning the housing structure hereinbefore described in the drum of the automatic washing machine. Then, with the lid of the housing structure open, an insert, as hereinbefore described, is inserted into the housing structure. In one embodiment such an insert contains within it at least two different compartments containing laundry additive materials which may be added at different times to the contents of the washing machine drum during the laundering cycle. The laundry additive materials contained in the compartments typically will be different but could be the same. In one embodiment, when the lid of the housing is closed, the selectively actuatable puncturing element may be effected to open at least a first compartment of the insert. This opening serves to dispense contents of the initially opened compartment(s) into the drum during the washing cycle. Alternatively, the selectively actuatable puncturing element may be effected to allow the automatic washing machine to run through its operational cycle, including at least one spin cycle, to thereby activate, via centrifugal force from the spin cycle, the selectively actuatable puncturing element to open a compartment of the insert containing laundry additive materials which permits dispensing of the contents of those compartments into the drum of the washing machine in a subsequent wash or rinse cycle.

In its device aspects, the present invention relates to a housing hereinbefore described. It is this housing structure which is to hold the unit dose insert as hereinbefore described and bring about the selective dispensing of laundry additive materials from the insert. The housing structure is suitable for positioning in a fixed spatial relationship to, and preferably within, the drum of an automatic washing machine for fabric laundering. The housing structure comprises a base which is suitable for holding the insert containing the laundry additive materials to be dispensed. The structure further includes an openable and closable lid for the base. Finally, the housing structure includes at least one selectively actuatable puncturing element for optionally opening initially at least one or more compartments of the insert which is placed within the structure. Such puncturing element may be actuated when the lid of the structure is closed with the insert inside the structure at the beginning of the laundering cycle and/or actuated to open one or more compartments of the insert to release the additive(s) in a subsequent wash or rinse cycle of the laundering cycle. In another embodiment of the invention, the selectively actuatable puncturing element may open one or more of the compartments in one rinse cycle of a multiple rinse cycle laundering operation by means of a cam follower and cam track operatively associated with the puncturing element.

In its "kit" aspects, the present invention relates to combinations of items which can be provided or sold together in order to facilitate assembly and use of the laundry additive material dispensing systems herein and the practice of the methods of this invention. Thus such kits can comprise the combination of the insert as hereinbefore described and the housing structure also as hereinbefore described. Such kits can also comprise the unit dose inserts in combination with instructions on how to use such inserts with a pre-existing housing structure in order to assemble the laundry additive dispensing systems herein or in order to carry out the methods-of-use herein.

BRIEF DESCRIPTION OF THE DRAWINGS

FIG. 7A shows the arm and knife blade in a non-piercing position. FIG. 7B shows the arm and knife blade in a piercing position.

DETAILED DESCRIPTION OF THE INVENTION

Figure 2:
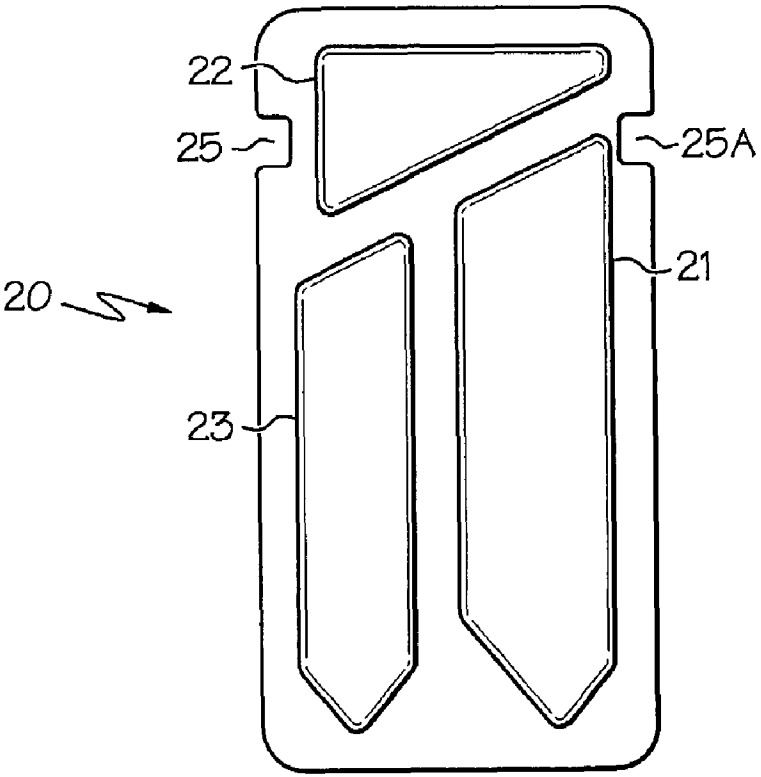
FIG. 2 is a front view of another example of three-compartment unit dose insert which can be utilized in the present invention.

The present invention relates to the dispensing of laundry additive materials into the drum of an automatic washing machine as that machine is used for fabric laundering operations. For purposes of this invention, "laundry additive materials" can comprise any solid or liquid materials which are conventionally added to the automatic washing machine drum, along with the fabrics being laundered, in order to effectively carry out the desired laundering procedure. Thus the list of suitable "laundry additive materials" includes, but is not limited to, detersive surfactants, detergent builders, bleaches, enzymes, bleach and enzyme stabilizers, bleach and enzyme activators, aqueous and non-aqueous solvents, pH adjustment and control agents, dispersants, anti-redeposition agents, dye transfer inhibitors, preservatives, antimicrobial agents, soil release agents, anti-wrinkle agents, fabric softeners and conditioners, chelating agents, suds suppressors, suds boosters, optical brighteners, perfumes, pro-perfumes, dyes, and carriers. A more detailed description of various laundry additive materials useful in this invention can be found in WO 00/02982 and WO 00/02987.

Dispensing of laundry additive materials in accordance with this invention takes place in a conventional automatic washing machine useful for the laundering of fabrics. Such automatic washing machines are those typically found in the home or in businesses such as self-service laundromats wherein individual consumers can launder their own loads of fabrics.

Automatic washing machines of the "North American" configuration typically utilize an upright or vertical drum or tub into which fabrics to be laundered are placed. Fabrics and laundry additives are added into the washing machine tub or drum, which is usually cylindrical, from the lidded top of the machine and are thus generally referred to as "top-loading" machines. Such North American style machines will frequently utilize a vertical agitator element placed along the axis of the drum. Rotation and vertical motion of the agitator serves to intensify the contact of fabrics in the drum with wash and rinse water in the drum. Japanese washing machines are typically similar in configuration to the North American machines.

Automatic washing machines of the "European" configuration commonly utilize a drum or tub, also generally cylindrical, which is positioned with the drum axis sideways or in a horizontal position. Fabrics and laundry additive materials are placed into the tub or drum of a washing machine of this configuration through a door on the front wall of the machine and are thus generally referred to as "front-loading" machines. Automatic washing machines of the European configuration typically do not utilize an agitator device or element.

Both North American and European automatic washing machines utilize a cycle of operation wherein the machine goes through a series of steps in which water is added, contacted with fabrics being laundered and then removed from the washing machine drum. Thus after fabrics are added to the drum, the first step in the laundering cycle is usually a washing step wherein significant amounts of water are added to the drum. The washing step involves a period wherein the fabrics being laundered are contacted with substantial amounts of water, generally with agitation or rotation of the drum. Water in the washing step will usually contain the primary laundry additives such as surfactants, builders, bleaches and/or enzymes which assist in and promote the removal of soil and stains from the fabrics being laundered.

At the conclusion of the washing step, water is removed from the washing machine drum. Frequently, this is brought about by gravity flow of wash water from the drum through appropriate valve configurations. Generally wash water is also removed by means of centrifugal force brought about by the drum rotating rapidly in a spin cycle. This centrifugal force moves water in the drum through holes or apertures in the circumferential walls of the drum. These holes lead to drainage means which can be opened and shut.

After the initial spin cycle, clean water is added back to the drum in a rinse cycle. Secondary laundry additives such as fabric softeners or conditioners are generally contacted with the fabrics being laundered during the rinse cycle. Washing machine operation may also involve several additional spinning and rinsing cycles.

The system, methods, apparatus and kits of the present invention are intended to provide dispensing of laundry additive materials into the laundering process from a single unit dose package. Such additive materials are dispensed into the washing machine as the machine proceeds through its operational wash and initial spin and rinse cycles as hereinbefore described. This is accomplished using a housing structure which is positioned within the machine and which holds and opens compartments of a unit dose package containing the additive materials to be dispensed. The housing structure comprises a selectively actuatable puncturing element whereby the compartments may be optionally opened so as to release the additives during the wash cycle or the rinse cycle or during both the wash and rinse cycles. Ideally the unit dose used herein will contain from 15 to 100 grams, preferably from 40 to 80 grams, of laundry additive materials for delivery to the wash cycle of an automatic washing machine laundering operation and from 5 to 50 grams, preferably from 15 to 35 grams, of additional laundry additives for delivery to one or more subsequent "rinse" cycles in this laundering operation.

The housing structure used in the instant invention is positioned in a fixed spatial relationship to the washing machine drum. Preferably, the housing structure is rigid and will be positioned within the washing machine drum in a location such that it will be in contact with the wash or rinse water in or being added to the drum during the wash and/or rinse cycles of the laundering operation. The housing structure may be positioned on or near the washing machine agitator (if there is one) or may be positioned on the floor (top loaders) or rear wall (front loaders) of the drum. Most preferably, however, the rigid housing structure will be affixed to the inner circumferential wall of the washing machine drum in a position so that at least at some point during the washing and rinsing cycles it is in contact with water used in the cycle. For North American washing machines, this position will preferably be below the fill line for water in the drum.

Figure 6:
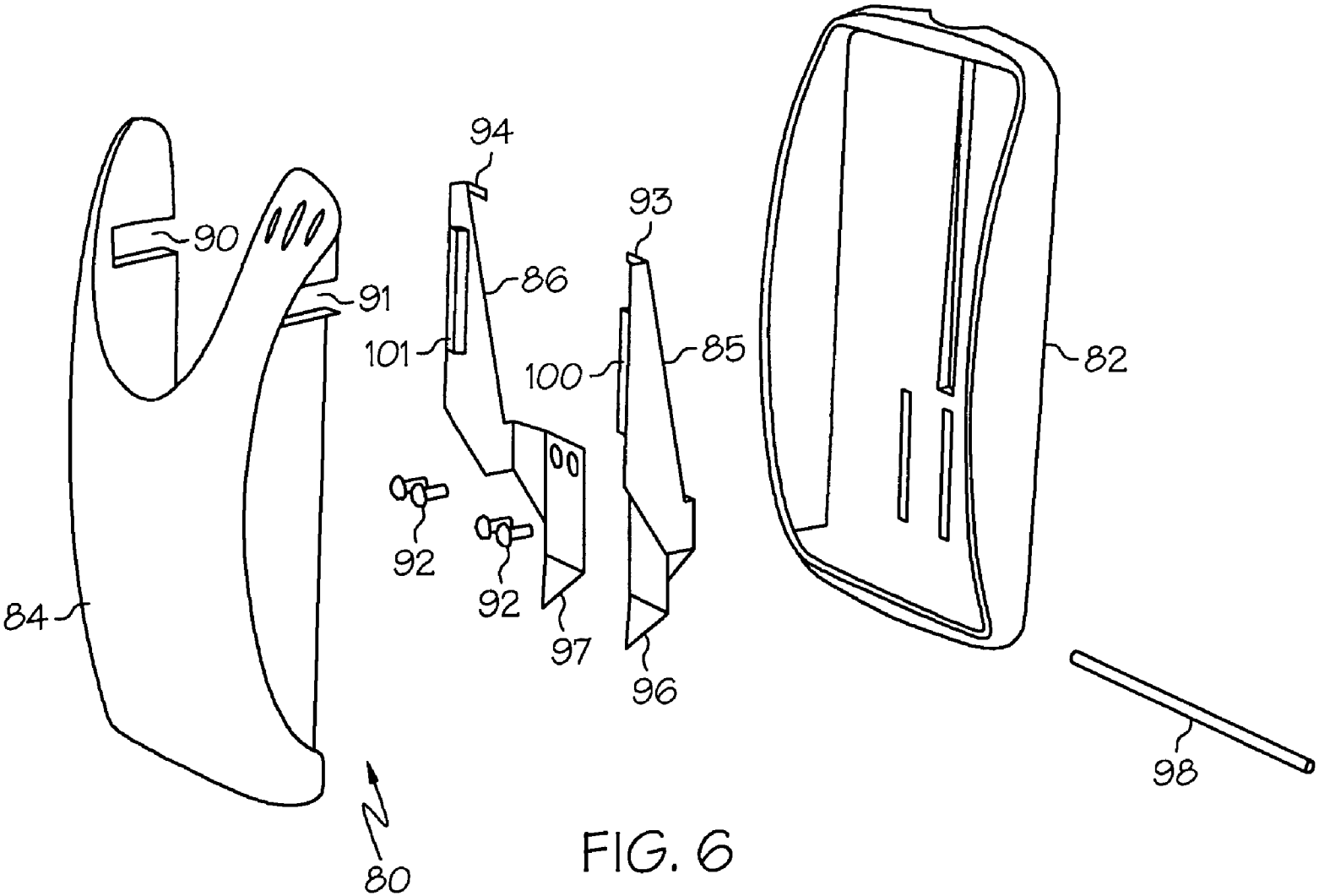
FIG. 6 is an exploded view of one embodiment of the housing structure of the present invention.

One example of a housing structure is shown in FIG. 6 and includes a base 82 and an openable and closable lid 84 for the base. The base element 82 can be sized and configured in order to hold in an appropriate way the insert which carries the additive materials to be dispensed. The housing structure 80 includes at least one (but in this embodiment two) selectively actuatable puncturing elements 85, 86 which control the opening of the compartments during the wash and/or rinse cycles, whereby at least one of the compartments of the insert is optionally opened when the insert is placed in the housing 80 and the lid 84 is closed or whereby at least one of the compartments of the insert is optionally opened during a subsequent spin cycle. The selectively actuatable puncturing elements 93, 94 also can be effected to open at least one of the compartments of the insert upon closing the lid 84 to release the additive during the wash cycle and at least one of the compartments of the insert during the first spin cycle so as to release the additive during the subsequent rinse cycle. Thus, the puncturing elements can be actuated at different points in the cycle and the puncturing elements do not have to be identical. They can be designed differently to puncture different containers at different times and in different locations. Those skilled in the art will recognize that based on the teachings herein one skilled in the art can design the dispenser to open the compartments in the insert so as to selectively dispense the additives to any of the wash or rinse cycles used in the laundry cycle.

Figure 7A:
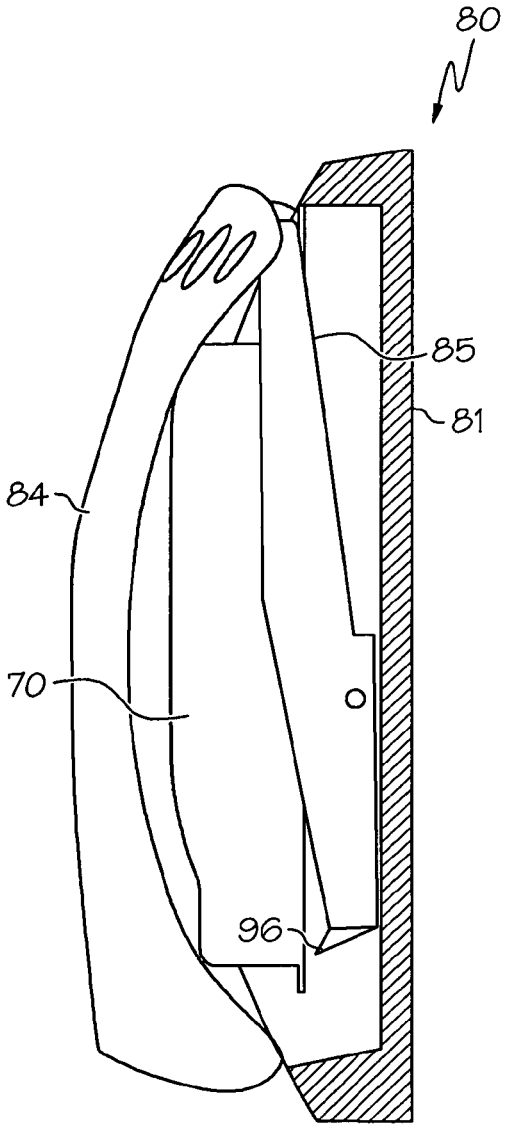
FIGS. 7A and 7B are side views of one embodiment of the housing structure and unit dose insert of the present invention.

In one embodiment of the invention, the housing structure includes at least one notch 90, 91 that is located to receive a tab 93, 94 on the arms 85, 86 so that the lid 84 does not deflect or pivot the arms when the lid 84 is closed. Attached at the base of each arm 85, 86 is a puncturing or rupturing element 96, 97 non-limiting examples of which include a sharp protrusion, a knife blade or a pick, punch, or saw/serrated edge. The arms 85, 86 include weights 100, 101 which generate pivoting movement of the arms from the non-piercing position to the piercing position when centrifugal force from the spin cycle is applied. When the arm 85 is in a non-piercing position, as shown in FIG. 7A the knife blade 96 of the arm 85 is withdrawn or retracted and does not pierce the compartment of the insert when the insert is placed into the housing structure 80; however, when the arm 85 is pivoted into a piercing position, the knife blade 96 moves toward the lid 84 and pierces the compartment of the insert 70 to dispense the material in the compartment. By blocking or not blocking access of the tabs 93, 94 to the notches 90, 91 in the lid 84 (as seen in FIG. 6), the arms 85, 86 can be selectively actuated so that the additive can be released during the wash cycle and/or the rinse cycle. In one embodiment, the notches 90, 91 can be blocked by the peripheral edge 15A (see FIG. 1) of the insert. In this case, when the lid is closed, the insert edge 15A pushes the tab 93 (FIG. 6) on arm 85 into the base 81 causing the knife 96 to move forward and puncture the insert 70. If the edge of the insert includes a cut-out 15, the tab 93 on the arm 85 moves into the notch 90 in the lid 84 and the arm is not pivoted so that the compartment is not ruptured until a subsequent spin cycle. The foregoing is only an illustration of one embodiment of the invention and the selectively actuatable puncturing element is not limited to the illustration. Other examples of ways to block the notches include movable tabs on the notched openings of the lid or the base such that when specific inserts having the features described below are utilized, they can be used cooperatively with the selectively actuatable puncturing element to control the time of piercing of the compartments, thereby regulating dispensing at the wash cycle and/or rinse cycle.

In a particular embodiment as discussed above, inserts with features are used in cooperation with the selectively actuated puncturing element to control whether the additive is released at the wash and/or rinse cycle. The feature can be the presence of or the absence of a notch or cut-out as illustrated by the cut-out 15 in FIG. 1. In one embodiment, the feature 15 is located at the periphery of the insert; however, the feature could be located at other locations in the insert. In addition to a cut-out, the feature could take other forms. For example, it could be a tab member extending from the insert that interacts with the arm such that when the tab is present (or absent), the arm is actuated to pierce the compartment so as to release the additive during the wash or a rinse cycle. In this manner, the piercing of the insert may be controlled to be performed during a spin cycle following a wash cycle or a rinse cycle by using features on the insert. In another embodiment, the insert may comprise different features. For example, if the feature is a cut-out on one side of the insert, the other side of the insert may have a feature which is an absence of a cut-out as is the case in FIG. 1. In this way, dispensing at both the wash and rinse cycle can be controlled with a single insert since the compartments on the side of the insert having a feature such as a cut-out may be released during the rinse cycle while the compartments on the other side of the insert not having the cut-out may be released during the wash cycle.

A description of one non-limiting embodiment of the invention is discussed below for the purpose of illustration only and the selectively actuatable means and the corresponding insert are not limited to the example discussed herein.

Figure 7B:
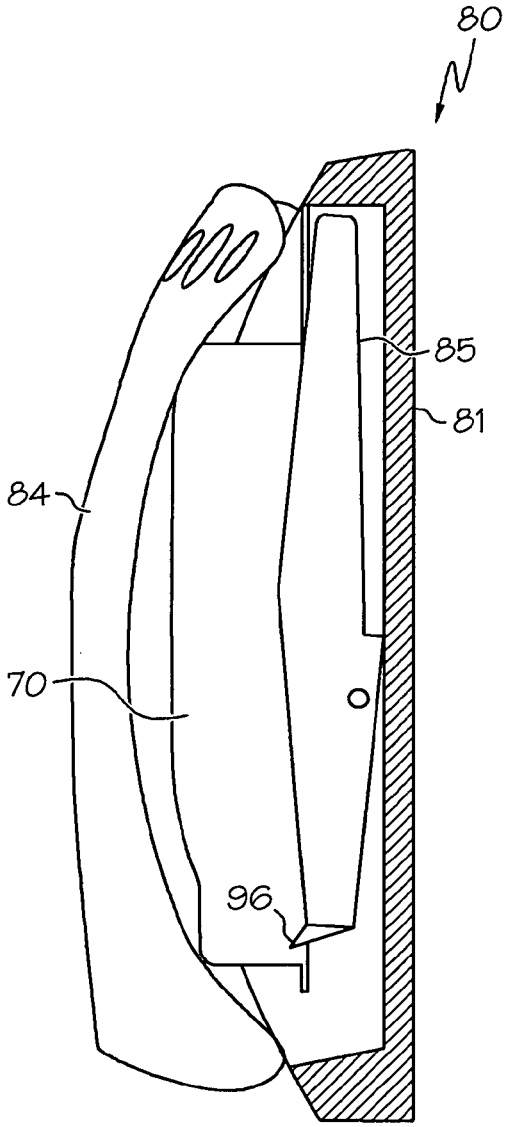

When the insert 11 is put into the lid 84 and the lid 84 is closed, the un-notched edge 15A of the insert 11 moves the tab 94 towards the base 82, thereby pivoting the arm 86 into the activated position, causing the knife blade 97 to pierce the bottom of compartment 17 upon closing of the lid 84 as shown in FIG. 7B. Accordingly, in this embodiment the additive compartment is opened and the additive drains from the compartment 17 and is released at the wash cycle. Generally, such means are activated by the closing of the lid of the housing structure once the unit dose insert has been placed inside the structure. The time during the laundry cycle when the additive is released from the compartment is a function of when the compartment is ruptured and also where the compartment is ruptured. When the compartment is ruptured near its bottom, the additive can drain from the compartment immediately. However, if the compartment is ruptured near its top, the additive may not be released until the tub fills with water or it may not be released until a spin cycle when the centrifugal force forces the additive from the compartment. While in one embodiment, when the selectively actuatable puncturing element is actuated the additive drains into the tub immediately, depending on the placement of the rupturing point, the release of the additive may not be immediate but may be delayed as previously discussed.

Non-limiting examples of such puncturing elements can comprise, selectively located puncturing or rupturing elements non-limiting examples of which include sharp protrusions or knife blades or serrations which pierce one or more of the selectively positioned compartments of the unit dose insert. The rupturing or puncturing means are then configured to move with the closing of the lid such that this movement causes the desired compartment(s) of the insert to be opened.

To release the additive during the rinse cycle, an insert 11 that has a cut-out 15 on a side of its periphery can be used. When the notched insert 11 is put into the housing 81 and the lid 84 is closed, the cut-out 15 of the insert is aligned with the notched opening 91 on the side of the lid 81 and further becomes aligned with the tab 93 on the arm such that the closing of the lid does not move the tab allowing the arm to stay in a position as shown in FIG. 7A, whereby the knife blade 96 does not pierce the compartment. As described hereinbefore, the arms 93, 94 include weights 100, 101 which generate movement of the arm from the initial position to the activated position when centrifugal force from the spin cycle is applied. The movement of the arm to the activated position as shown in FIG. 7B causes the knife blade to pierce the bottom of compartment 17 of the insert 11 which allows for the dispensing of the material during the rinse cycle. The additive tends not to be released in quantity during the spin cycle.

Accordingly, the selectively actuated puncturing element allows for the dispensing of materials at the wash cycle, the rinse cycle or at both the wash cycle and rinse cycle. In order to dispense materials at the wash cycle only, an insert without cut-outs 15 is used. Upon closing of the lid 84, both arms are activated as described hereinbefore, and the materials are dispensed during the wash cycle. In order to dispense materials at the rinse cycle only, an insert that has cut-outs on both sides may be used. Upon closing of the lid, the arms are not deflected by the insert and stay at the initial position and are only moved to the activated position by the centrifugal force by the spin cycle, allowing the arms to pivot the knives and to open the compartments in the insert so that dispensing takes place during the rinse cycle.

In another embodiment, the selectively actuated puncturing element allows for the dispensing of materials at both the wash and rinse cycle when an insert that is notched on one side and not notched on another side is used. The uncut-out side 15A of the insert contacts with the corresponding tab 93 causing movement of the corresponding arm 85 into an activated position resulting in the compartment being opened when lid 84 is closed; the cut-out side 15 of the insert allows for the puncturing of the material in compartment 12 during the subsequent spin cycle. Thus, by selecting the proper insert, the time of puncturing the compartment can be controlled.

Figure 8:
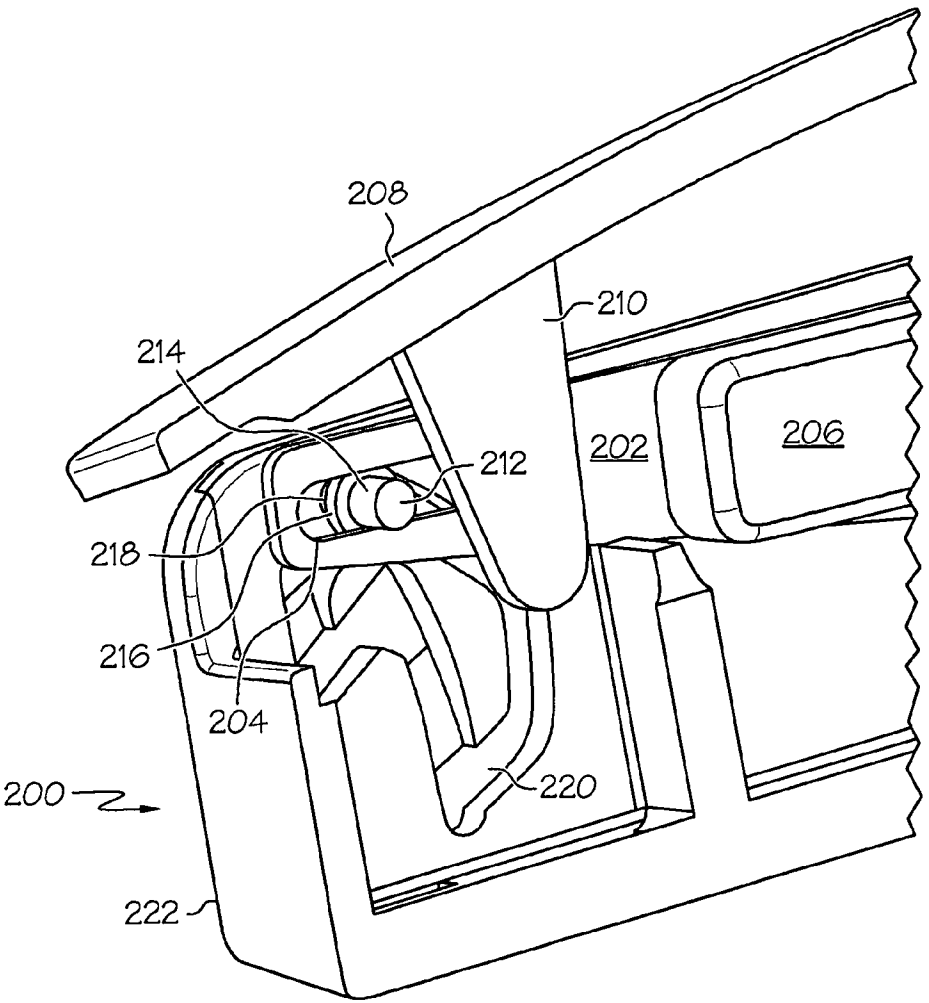
FIG. 8 is a partial view of the side wall of a dispenser having a cam track in accordance with another embodiment of the invention.

In yet another embodiment of the invention, the universal dispenser may be used in a multiple wash and/or rinse cycle laundering operation, wherein in one non-limiting embodiment the laundering cycle would comprise a wash cycle and rinse cycles. As illustrated in FIG. 8, the desired rinse cycle in which the additives are to be dispensed can be controlled by employing a track or channel 220 and cam 212 in the dispenser to control at which rinse cycle the additives are dispensed. As shown in FIG. 8, a cam 212 rides in a slot 204 in the arm 202 and at the base of the arm is a puncturing or rupturing element 226 such as a sharp protrusion or a knife blade (not shown in FIG. 8 but analogous to FIG. 7). The cam 212 runs along the channel 220 as the arm 202 is pivoted back and forth by the centrifugal force in the washer and the force of a spring (not shown) that acts in a direction opposite the centrifugal force. The arm 202 includes a weight 206 which causes movement of the arm 202 and cam 212 along the channel 220 when centrifugal force from the spin cycle is applied. The centrifugal force from a spin cycle causes the cam to move from a first position in the channel 220 to a second position. With each subsequent spin cycle the cam is moved to a subsequent position along the channel. The position of the cam 212 determines the position of the arm 202. One of the positions of the cam 212 will position the arm 202 in a piercing position to release the additives. Thus the specific cycle in which the additives are to be released can be controlled with the position of the cam in the channel. Essentially, the channel has multiple positions for the cam that coordinate with multiple cycles. The specific rinse cycle in which the additives are to be released correlates with the position on the channel in which the cam moves the arm to the piercing position.

The embodiment of FIG. 8 including the cam channel 220 differs from the embodiment of FIG. 6 in that the cam track configuration controls when the compartment containing the laundry additive is punctured by the arm and no interaction with a feature on the insert is required. On the other hand, in another embodiment, interaction with a feature on the insert, as in FIG. 6, can be used to control whether the insert is punctured upon closing the lid or upon a subsequent spin cycle as determined by the cam track configuration. It will also be understood that the dispenser may include more than one cam channel such that one arm can be controlled to puncture a compartment of an insert at one spin cycle and another arm can be controlled to puncture a different compartment at a different spin cycle. A dispenser may include one or more selectively actuatable puncturing element. Furthermore a dispenser may include one arm such as arm 85 in FIG. 6 that is controlled with a feature on the insert and another arm such as arm 202 in FIG. 8 that is controlled with a cam track.

Figure 4A:
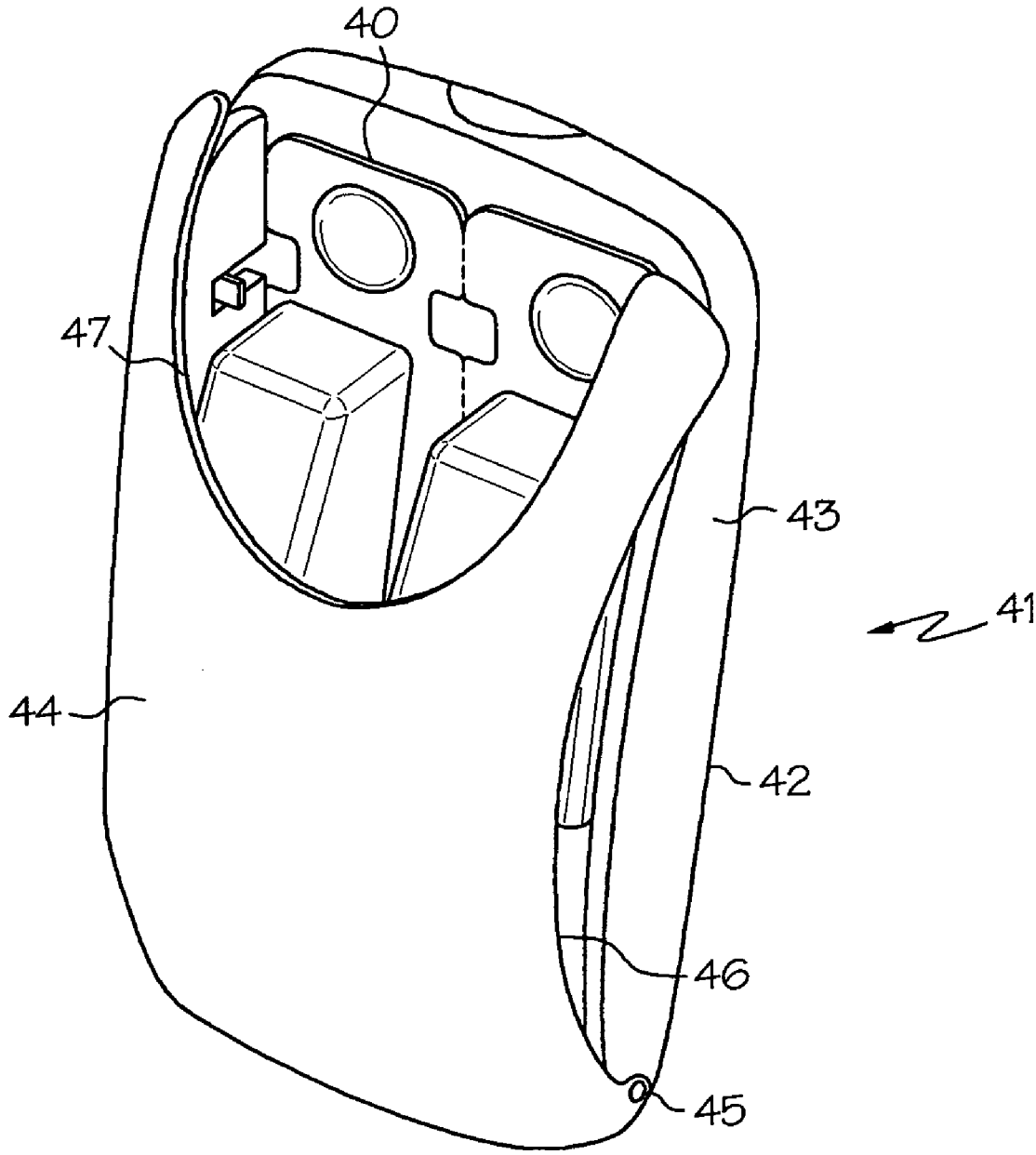
FIGS. 4A and 4B are front and back views of a unit dose insert positioned within a closed rigid housing structure suitable for practice of the present invention

The housing structure is configured to permit water to enter the structure during all of the various cycles of the laundering operation and to permit the contents of the opened insert compartments to be dispensed from the insert and into the washing machine drum. Most frequently this configuration will include appropriately placed and positioned openings or apertures in the housing structure through which water from the laundering operation can enter and leave and through which laundry additive materials from the opened insert compartments can flow into the washing machine drum. For example, as illustrated in FIG. 4A, the lid 44 does not enclose base 42 but rather includes substantial openings 46, 47 where water can enter the dispenser.

In one configuration, the housing structure will be able to hold substantially all (at least 90% by weight) of the rinse additive contents of the spin-cycle opened insert within the housing until the spin cycle is completed. Thus the centrifugal force which actuates the puncturing element can also be used to hold the contents released from the opened compartment(s) within the structure, and even in some cases still within the opened compartment(s) of the insert, until the spin cycle is over. At the conclusion of the spin cycle, when the centrifugal force ceases, the contents of the opened inserts can then be allowed to flow from the structure, for example by gravity, through holes in the housing. Similarly, upon cessation of the spin cycle centrifugal force and the addition of rinse water to the drum, the released rinse additive materials can be washed from the structure, and into the washing machine drum, by rinse water then entering the housing. By having the structure (or the insert) retain the released rinse additive materials until the spin stops, the rinse additive material can thereby be kept from being washed out of the washing machine drum by being forced out of the drum through the drainage holes in the drum wall during the spin cycle.

Opening of each of the several compartments of the insert within the housing structure should permit most (at least 85% by weight), and preferably almost all, of the contents of the compartment so opened to be eventually combined with the wash or rinse water present in the washing machine drum during the cycle in which the compartment is opened. The wash water in the drum during the wash cycle will typically have delivered thereto from 15 to 100 grams, preferably from 40 to 80 grams, of laundry additive materials as a consequence of the opening of the wash additive compartment(s) of the insert. Rinse water in the drum for any rinse cycle during which a rinse additive compartment is opened in the insert will typically eventually have added thereto from 5 to 50 grams, preferably from 15 to 35 grams, of rinse additive material as a consequence of the opening of the rinse additive compartment(s).

The housing structure can be fashioned from any suitable solid material including but not limited to plastic, metal, ceramic, wood, etc. so long as the structure maintains its configuration and mode of operation through the laundering cycle and in contact with the wash and rinse water used and with the laundry additive materials released from the opened unit dose insert compartments. Preferably the housing structure will be fashioned from thermoformed or injection molded plastic so that it can be readily and cost effectively mass-produced.

The unit dose insert includes at least one liquid compartment and is sized and configured so as to work cooperatively with the housing structure into which it fits and within which it is used. In one embodiment, the unit dose insert includes at least two separate compartments, at least one for laundry additive materials which are to be dispensed into the wash water at some point during the wash cycle (typically the laundry additive material is dispensed into the wash water at the beginning of the laundering operation) and at least one for rinse additive materials which are to be dispensed into the subsequent rinse cycle during the course of the laundering operation. Of course, the unit dose insert may utilize more than one compartment for the wash water additive materials and more than one compartment for the rinse additive materials. This may be useful when two or more wash or rinse additive materials are incompatible with each other and may be desirably separately packaged until they are added to the washing machine drum.

Each compartment of the unit dose insert may be fashioned from water-insoluble materials, water-soluble materials or combinations of both types. Furthermore, some compartments of the insert may be made from water-insoluble materials while other compartments can be made from water-soluble materials. The compartments of the insert may also be flexible or rigid or have some compartments flexible and other compartments rigid.

If the unit dose insert is to be rigid, it may be made, for example, from any conventional polymeric material which can be thermoformed or injection molded. Thus polyethylene, polypropylene, polystyrene or polyester (e.g., polyethylene terephthalate) are non-limiting examples of materials which may be used to form the multi-compartmented insert. A polymer material should be chosen which has good heat stability, especially if the insert is to be utilized in European washing machines where water temperatures approach boiling. The material(s) used to form the insert should also be inert to any chemicals which are present in the laundry additives which the insert is to deliver.

A preferred configuration for the unit dose insert comprises a multi-compartmented thermoformed tub formed from water-insoluble plastic, such as for example, polypropylene or polyethylene. The compartments of the tub can be sealed with a thin layer of puncturable or rupturable plastic or metal, e.g., aluminum, foil. In another preferred configuration, a pouch with the wash water additives may be flexible and fashioned from water-soluble materials, e.g., polyvinyl alcohol, and this water-soluble pouch may be affixed to a flexible or rigid pouch or compartment made from water-insoluble materials and containing the rinse additive materials to be dispensed later in the laundering cycle.

In one embodiment herein, the multi-compartmented insert itself may contain the means for opening the compartment(s) containing rinse additive materials. These are the compartments to be opened by means of the centrifugal force applied to the insert during the spin cycle of the laundering operation. Such rinse additive compartments may thus contain a frangible seal which comes apart or opens as pressure on the contents of the compartment increases as a consequence of the centrifugal force applied during the spin. Alternatively, the means for opening the rinse additive compartment(s) may be part of the housing structure as hereinbefore described. Of course, the means for opening the rinse additive compartment(s) should be present in association with at least one of the rigid housing structure or the multi-compartmented insert itself so that, one way or another, the rinse additive compartment(s) will be opened at the appropriate time during the laundering operation.

Figure 1:
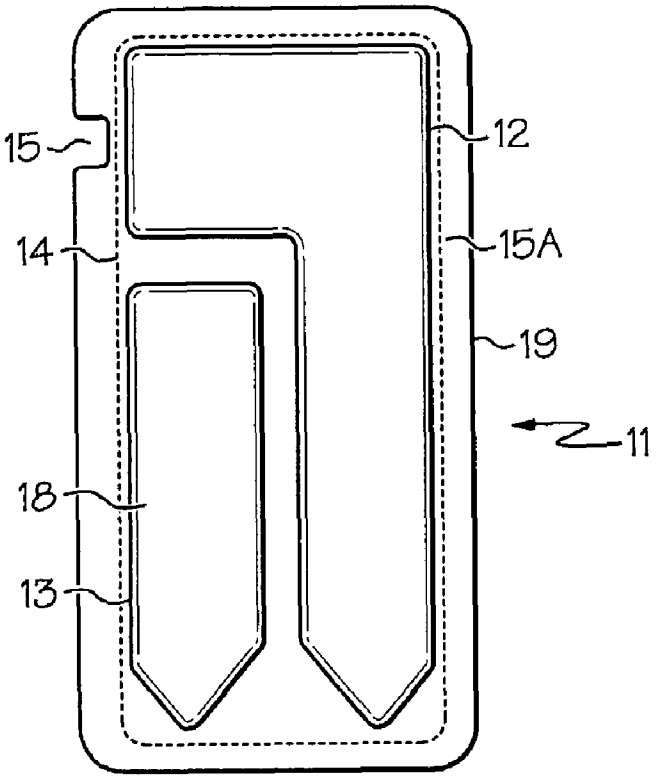
FIG. 1 is a front view of one example of a two-compartment unit dose insert which can be utilized in the present invention.

Non-limiting examples of the multi-compartmented unit dose insert, the housing structure and their relationship to each other for use in the systems and methods and kits herein are illustrated in the accompanying drawings. FIG. 1 of the drawings shows a non-limiting embodiment of an insert useful in one embodiment of the present invention. Referring to FIG. 1, a two-compartment unit dose insert 11 which can be employed in the practice of the present invention is shown. This compartmented unit dose insert 11 can be made of relatively rigid, insoluble thermoformed polypropylene. It has a compartment 12. Compartment 12 may be used to store a laundry additive, a non-limiting example of which is a liquid laundry additive, such as a heavy duty liquid detergent, to be dispensed into the wash cycle of a laundering operation. The insert edge adjacent this compartment 12 does not include a cut-out 15A. The two-compartment unit dose insert 11 also has a smaller minor compartment 13 suitable for holding liquid laundry additive, non-limiting examples of which include fabric conditioning agents or pH control agents, to be dispensed into the rinse cycle of the laundering operation. Prior to use, both compartments are sealed across the top with a puncturable or rupturable layer 14 of film or foil which covers both compartments 12 and 13. The unit dose insert 11 has a cut-out 15 on the side adjacent compartment 13 which is used as discussed earlier to control the dispensing of compartment 13 at the rinse cycle whereas the unit dose insert 11 does not have a cut-out on the opposite side 15A which results in dispensing of compartment 12 during the wash cycle.

FIG. 2 shows a non-limiting example of a three-compartment unit dose insert 20 which can be employed in another embodiment of the present invention. This three-compartmented unit dose insert 20 has a large compartment 21 which may hold a liquid laundry detergent product and a smaller compartment 22 which may hold a granular peroxygen bleaching agent product. For illustrative purposes this is a non-limiting example of additives that are incompatible with each other if combined prior to use, and which are both dispensed approximately simultaneously into the wash cycle when the compartments containing each are both initially opened at the beginning of the laundering operation. The third compartment 23 may hold a liquid rinse additive product. It is this rinse additive product which is dispensed later in the laundering operation during the rinse cycle. The unit dose insert 20 has notch 25 on one side which is used to avoid actuating the puncturing element 97 when the lid is closed but allow the arm 86 to pivot and rupture compartment 23 to dispense compartment 23 during the rinse cycle. As in the two-compartment unit dose insert of FIG. 1, the compartments of FIG. 2 unit dose insert 20 are sealed with puncturable or rupturable film or foil (not shown) prior to the insertion of the unit dose 20 into a housing structure for use in accordance with this invention.

Figure 3B:
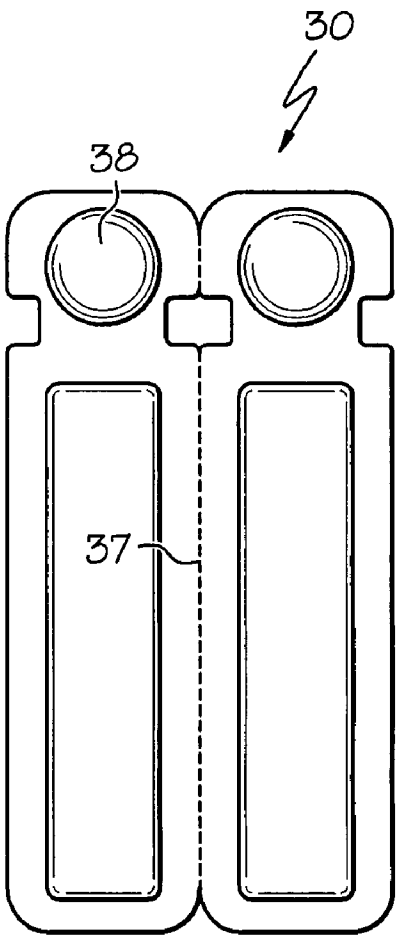
FIGS. 3A and 3B are other examples of two-compartment unit dose inserts which can be utilized in the present invention.
Figure 3A:
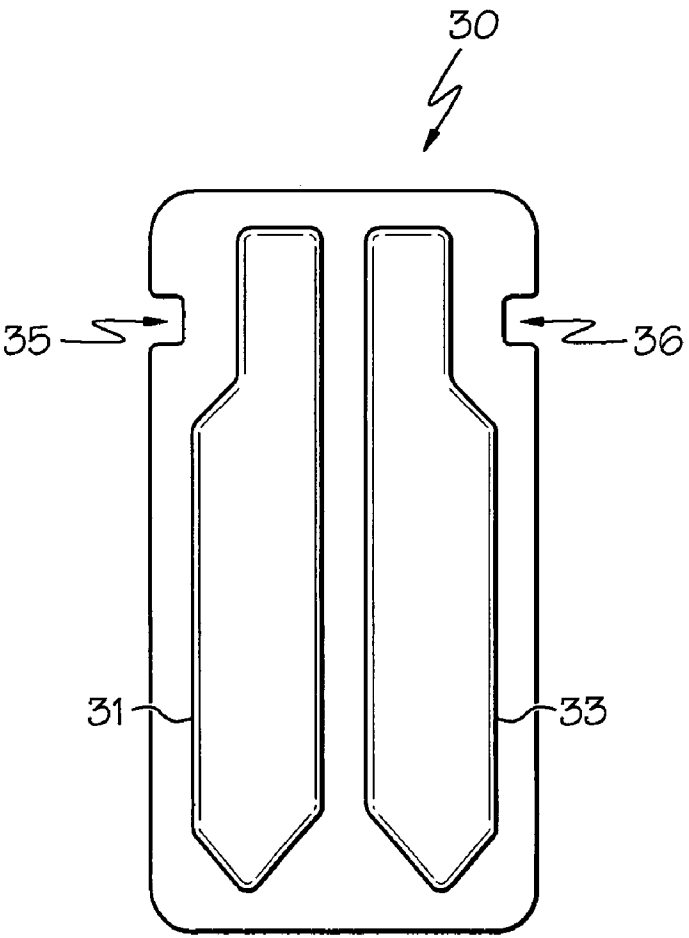

FIG. 3A shows a non-limiting embodiment of a two-compartment unit dose insert 30 containing two different ingredients for dispensing during the rinse cycle only. One compartment 31 may contain a softener, while the other compartment 33 may contain perfume. Additionally, the unit dose insert 30 has notches 35, 36 on each side of the insert 30 which function in conjunction with the tabs 93 and 94 on arms 85 and 86 as described above so that the contents of compartments 31, 33 are dispensed during the rinse cycle. FIG. 3B shows the unit dose insert 30 with a perforation 37 and a pair of finger holds 38 that allows the user to tear and use only half of the insert 30 at a time.

FIG. 4A shows an insert 40 which has been inserted into a housing 41 which has been closed with the insert 40 inside. The housing structure 41 itself comprises a base plate 42 surrounded by a side wall structure 43 affixed to the base plate 42. A lid 44 completes the housing structure and is affixed to the sidewall structure 43 by means of a hinge 45. During use water easily flows around the lid 41 through openings 46, 47 so that the contents of the insert 40 can be washed out of the housing 41.

Figure 4B:
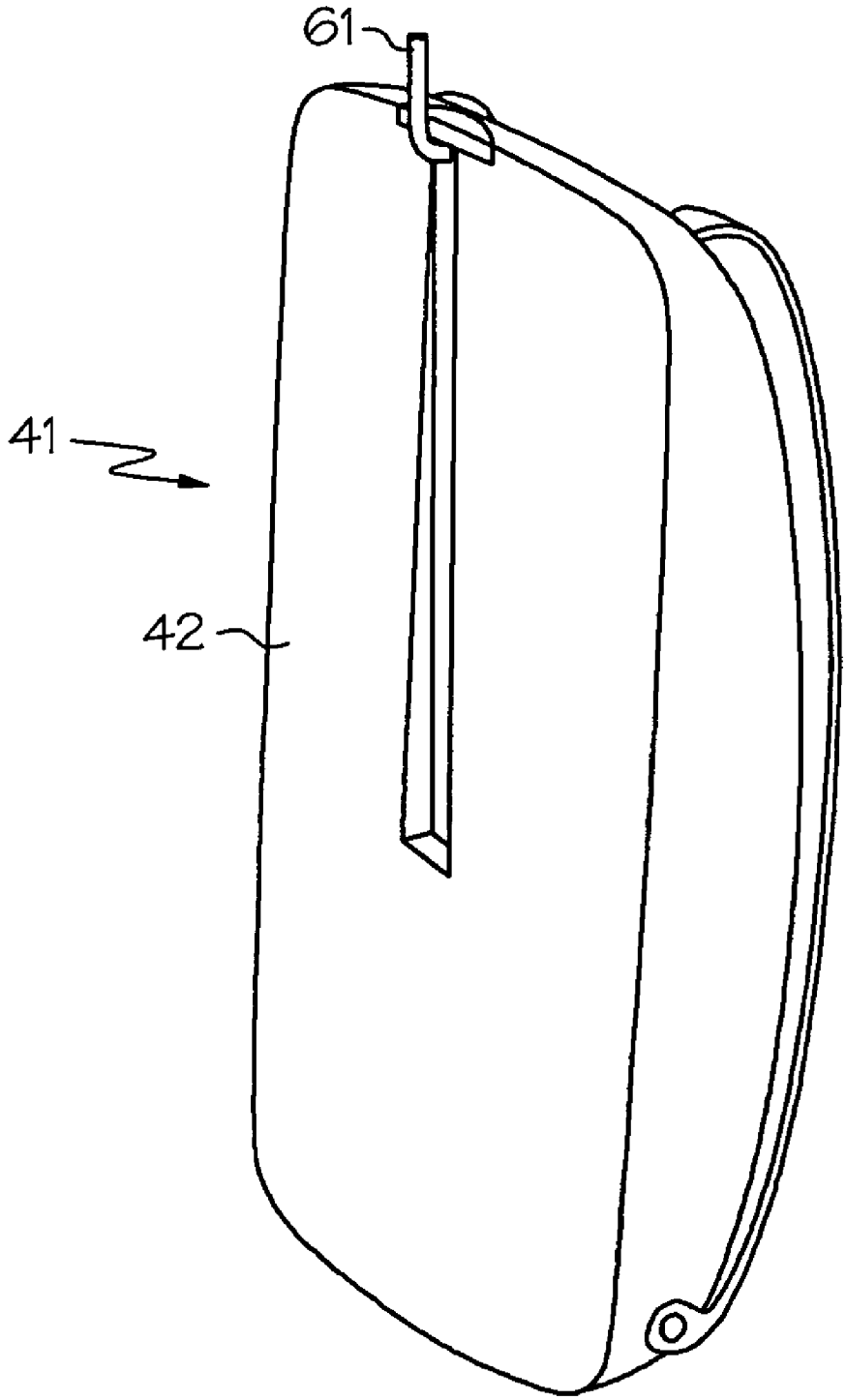

FIG. 4B shows a back view of an lidded housing structure 41. The base plate 42 comprises attachment means 61 which are used to affix the housing structure 41 to the inside wall of an automatic washing machine drum (not shown). One suitable non-limiting example of attachment means 61 is further described in U.S. application Ser. No. 10/737,429 filed Dec. 16, 2003. The housing structure 41 is affixed to the washing machine drum in a manner such that the base plate 42 is parallel to the axis of the washing machine drum and is hence perpendicular to the direction of centrifugal force which arises during the washing machine spin cycle.

Figure 5:
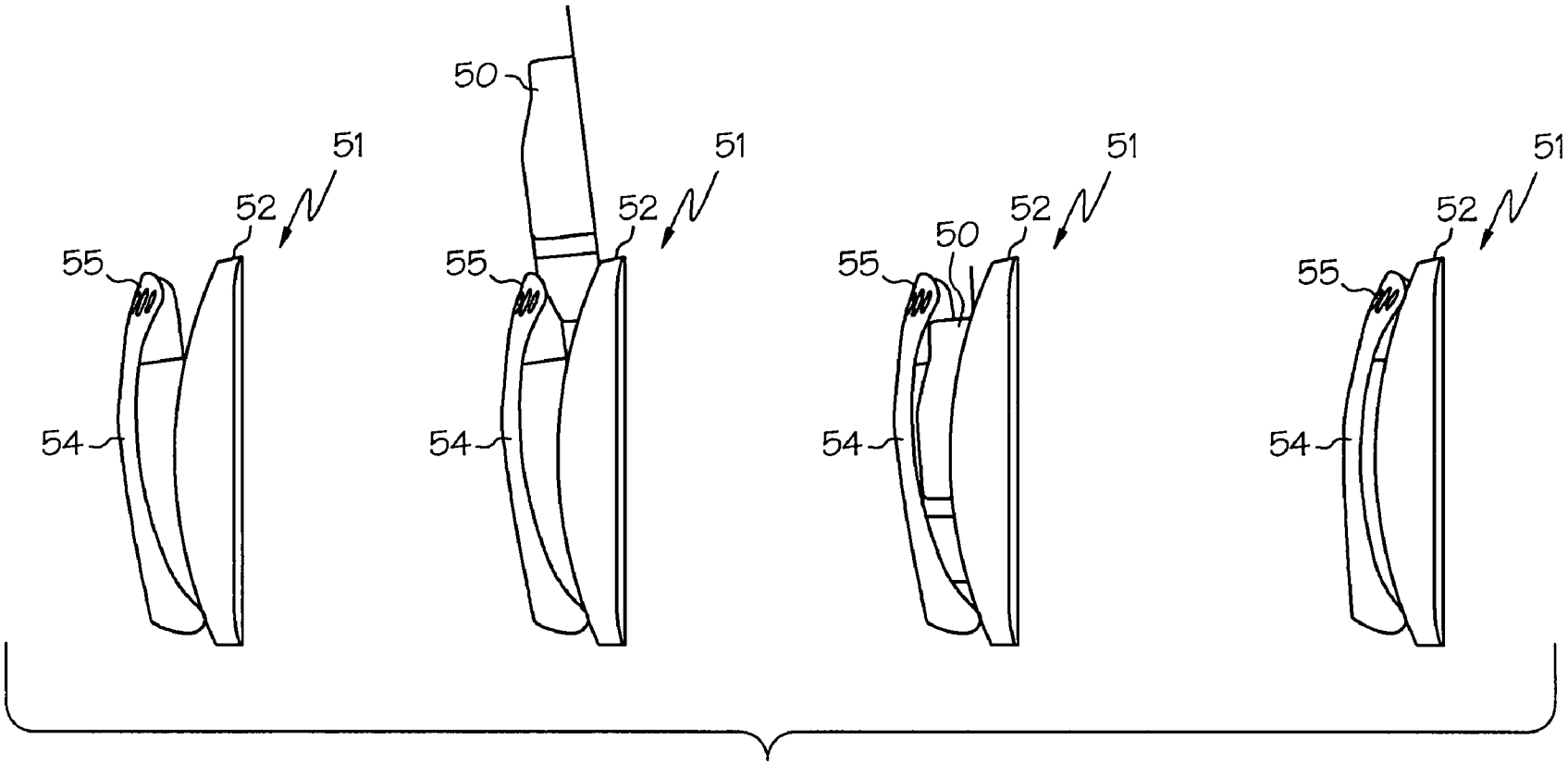
FIG. 5 is an elevated side view of the insertion and use of a multi-compartmented unit dose insert into one embodiment of a lidded, rigid housing structure suitable for the practice of the present invention.

FIG. 5 shows a progression from left to right in the drawings in which the housing structure 51 is shown in an open position with the insert 50 shown partially inserted into the housing structure 51, followed with the insert 50 shown fully inserted, and finally showing the insert 50 fully inserted with the lid 54 fully closed. The insert 50 is inserted into the housing structure with the compartments positioned toward the housing structure lid 54. The lid 54 is opened by squeezing the ends 55 of the lid 54 and moving the lid 54 away from the base of the base plate 52. The insert 50 is slid into the lid 54 so that when the lid 54 is closed, the latching mechanism is engaged.

FIG. 8 is a partial view of one side of a dispenser employing a cam track to control the movement of the knife arm in accordance with one embodiment of the invention. The dispenser 200 includes a knife arm 202 having a slot 204 at one end and a weight 206 that causes the arm to pivot upon the application of centrifugal force during the spin cycle. The dispenser further includes a lid 208 having a stop 210 that extends from the lid and blocks the cam track as discussed below. A cam 212 includes an inner post 214, a circular flange 216 and an outer post 218. The first post 214 slides in the slot 204 of the arm 202 while the second post 218 follows the cam track channel 220 that is located on the side wall 222 of the dispenser 200.

Figure 9A:
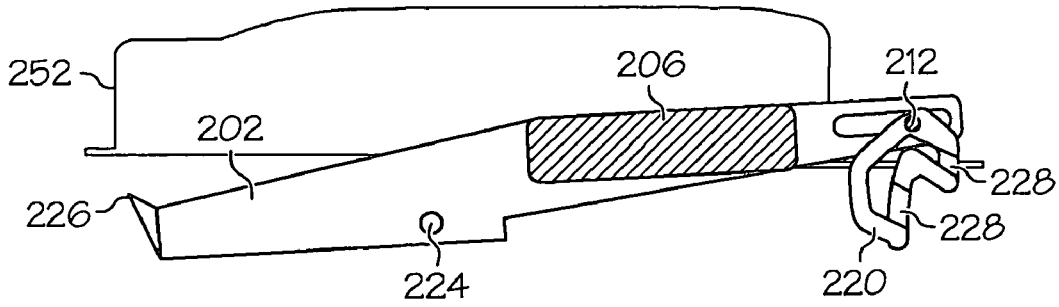
FIGS. 9A-9E are diagrams showing the relative movement of a cam track and knife arm for use in the multiple cycle laundering operations in accordance with one embodiment of the invention.
Figure 9B:
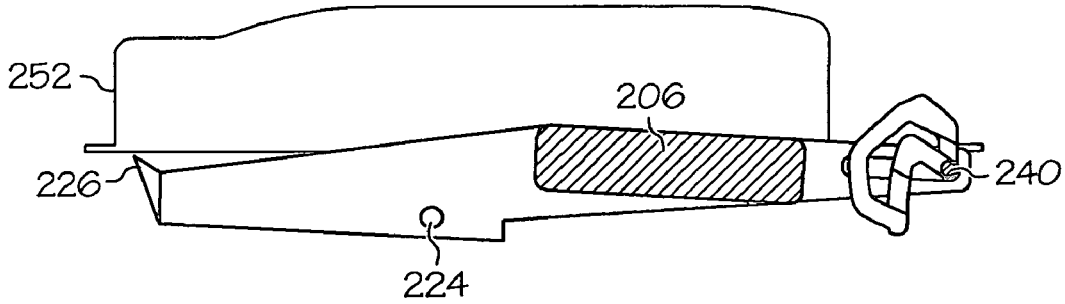
Figure 9C:
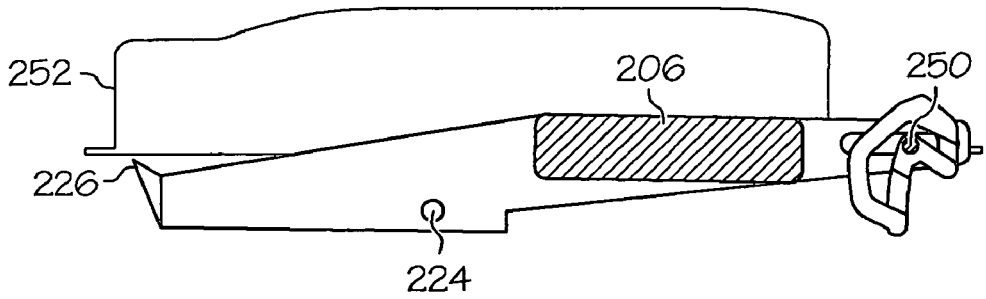
Figure 9D:
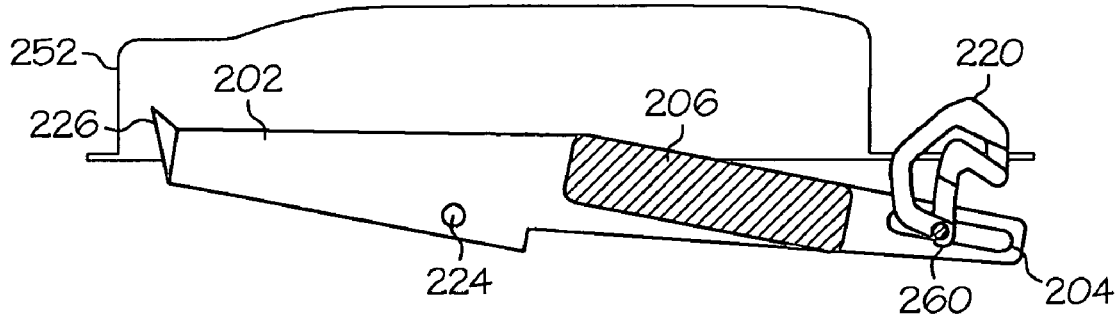
Figure 9E:
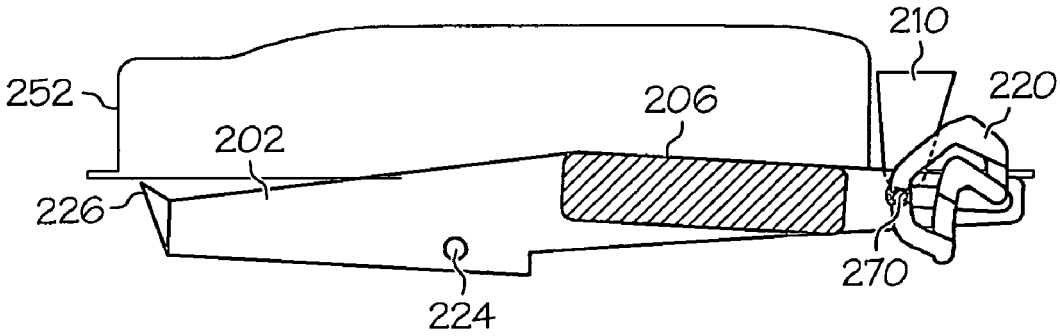

The operation of the cam track and arm is diagrammed in FIGS. 9A-9E. The arm 202 pivots about a point 224. A puncturing element 226 non-limiting examples of which include a knife edge or a pick is provided at one end of the arm 202. The cam channel 220 is formed with ramp portions 228 that control the movement of the cam 212 in the cam channel. The arm 202 is biased in the upward direction in FIGS. 9A-9E to pivot about the point 224 by a spring which is not shown. The direction of the centrifugal force produced during spin cycles is downward in FIGS. 9A-9B. During the first spin cycle as shown in FIG. 9B the arm is pivoted in the downward direction in FIG. 9B by the centrifugal force which overcomes the force of the spring biasing the arm 202 upward. As the arm pivots, it moves the cam 212 along the ramp 228 to the point 240. After the first spin cycle, the arm is pivoted upward which moves the cam follower 212 to the position 250. In this position the puncturing element 226 is not in a position in which it can rupture the insert 252. During the second spin cycle, the arm 202 is pivoted downward again by the centrifugal force. This causes the arm to move the cam 212 to the point 260 as it slides in the slot 204. In this position, the knife edge 226 at the end of the arm 202 ruptures the insert 252. After the second spin cycle as illustrated in FIG. 9E, the arm returns to its spring biased position whereupon the cam 212 abuts the stop 210. This prevents the cam 212 from moving to the starting position until the lid has been opened and the insert has been replaced.

In the illustration above, the track is a three-position track designed so that the additives will be released into the second rinse cycle of a laundry cycle having a single wash cycle. However, one skilled in the art can appreciate that the track can be designed with additional positions so that the additives can be released into a third or fourth or fifth etc. rinse cycles. For example, if the additives are to be deposited in the third rinse cycle of a multiple rinse cycle laundering operation, the track is designed so that the cam moves from a first position to a second position during the first spin cycle, from a second position to a third position during the second spin cycle, and finally from a third position to a fourth position on the track during the third spin cycle. The fourth position on the track is designed to move the cam and arm into a piercing position so that the additives are released into the third rinse cycle, which follows the third spin cycle.

Additionally, in accordance with a particular embodiment of the invention, as explained above, the lid 208 includes an extension 210 that forms a stop that prevents the cam 212 from returning to the starting position until the lid is opened. Upon opening the lid, the cam 212 is unblocked and the arm 202 is biased by the spring such that the cam 212 travels along the channel 220 and returns to its starting position as illustrated in FIG. 9A.

The method of using the above-described system for dispensing laundry additive materials into a fabric laundering operation can be illustrated by the following example:

EXAMPLE

A three-compartment unit dose insert is prepared having the general configuration of that shown in FIG. 2. The insert is fashioned from 0.381 mm thick polypropylene and is made by a thermoforming process. The insert so formed is 11.0 cm long, 7.0 cm wide and 2.5 cm thick and includes the three compartments, 21, 22 and 23 shown in FIG. 2.

Approximately 55 grams of a compact aqueous heavy duty liquid (HDL) detergent product are placed in the larger wash additive compartment 21 of the FIG. 2 insert. Such an HDL comprises approximately 40% by weight of anionic and nonionic surfactants, 8% by weight of organic builders, 19% by weight of organic solvents and minor amounts of other ingredients such as borax and enzymes.

Approximately 11 grams of a liquid bleaching composition are placed in the smaller wash additive compartment 22 of the FIG. 2 insert. Such a composition comprises a 6% by weight aqueous solution of sodium hypochlorite along with minor amounts of perfume.

Approximately 30 grams of a liquid fabric softener composition are placed in the rinse additive compartment 23 of the FIG. 2 insert. Such a fabric softener composition comprises approximately 4.5 by weight of ditallowdimethyl ammonium chloride (DTDMAC) softener active plus minor amounts of perfume and silicone.

The insert, with the compositions as hereinbefore described in each of the three compartments, is sealed with a 0.0304 mm layer of oriented polypropylene film placed over the open compartments. The sealed unit dose insert package is then placed in a rigid lidded housing structure of the type shown in FIG. 4. Prior to insertion of the unit dose package, this rigid housing structure is attached to the circumferential wall of the upright drum of a top-loading Kenmore 70 Series automatic washing machine. The housing is attached approximately 20 cm from the floor of the drum with the lid hinge closest to the floor of the drum and with the structure backplate parallel to the circumferential wall of the drum. The open end of the housing structure thus faces the top of the washing machine.

With the lidded housing structure in the open configuration, the three-compartment unit dose insert is placed therein as shown in FIG. 4A. Fabrics to be laundered are then placed in the washing machine. Just prior to starting the washing machine on its laundering cycle, the lid of the housing structure is closed providing the structure and insert configuration as shown in FIG. 4A. The washing machine is then started on its cycle.

For the purpose of illustration, an insert with one side notched and the other side un-notched as shown in FIG. 1 is used so that additives will be dispensed in both the wash and rinse cycles. Closing of the housing structure lid with the insert inside causes the tab on the side of the un-notched insert to move with the insert as the lid is closed, thereby pivoting the arm to a piercing position and thereby pivoting the puncturing means or knife blade to rupture the layer of sealing material covering the compartment on the un-notched side of the insert as discussed for FIG. 7. Such rupturing releases the wash additive ingredients together into the wash water which fills the tub at the beginning of the laundry cycle. In the meantime, the compartment on the notched side of the insert remains intact, because the tab of the arm on the notched side has not been moved due to the alignment of the tab, notch of the insert, and the notched opening of the lid.

After a wash cycle of approximately 14 minutes, the washing machine begins its spin cycle to remove the wash water from the drum. The centrifugal force generated by this spin cycle serves to push the weight on the arm towards the base plate, thereby activating the arm on the notched side of the insert and effecting the puncturing means or knife blade against the sealed rinse compartment of the insert within the housing. This action causes the seal of the rinse compartment to rupture and release the fabric softener contents of the rinse additive compartment into the housing structure. The continuing centrifugal force of the spin cycle holds the released fabric softener composition in the housing structure so that the released fabric softener rinse additive stays within the housing structure during the spin cycle.

After 2 minutes of the spin cycle, the spinning of the washing machine drum ceases and the drum begins filling with rinse water. At the same time, the rinse additive fabric softener composition which has been held within the housing structure during the spin cycle flows from the housing structure primarily through the bottom and into the rinse water. Rinse water in and entering the drum can also now enter the housing structure and wash out any residual fabric softener composition from the open rinse additive compartment. In this manner approximately 30 grams of the fabric softener rinse additive composition are introduced into the rinse water in the washing machine drum.

The rinse cycle continues for 5 minutes and thereafter the fabrics in the drum are wrung dry by a final spin cycle. Wash and rinse additives from the insert have thus been delivered sequentially to the wash and rinse cycles respectively during the laundering operation.

The rigid housing structure and the multi-compartmented inserts therefor may be conveniently commercialized by marketing them in the form of kits. Thus the housing and insert which are to be used together in the systems and methods of this invention may be sold together, packaged as a unitary commercial kit product. Furthermore, the multi-compartmented unit dose inserts may be sold by themselves as refills for use in a rigid housing structure which the consumer may have previously purchased and has already installed on the washing machine to be used for practice of this invention. In the case of refills, the inserts can be marketed in combination with a set of instructions which describes the previously-purchased housing structure into which the unit does fits and further describes the method of setting up and operating the housing/insert system in the consumer's automatic washing machine.

All documents cited are, in relevant part, incorporated herein by reference. The citation of any document is not to be construed as an admission that it is prior art with respect to the present invention. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for dispensing laundry additive materials into one or more stages of a laundering cycle which occurs during the operation of a drum-containing automatic fabric laundering washing machine, which system comprises:

A) a housing structure positioned within the washing machine in a fixed spatial relationship to the washing machine drum, which housing structure comprises a base and an openable and closable lid for the base;

B) an insert having at least one compartment which can be placed within the housing structure, the insert containing a laundry additive; and C) a selectively actuatable puncturing element that controls the time at which a compartment containing a laundry additive is punctured, the selectively actuatable puncturing element being movable between a first position in which the selectively actuatable means does not pierce the insert to a second position in which the selectively actuatable puncturing element pierces the insert, and wherein the selectively actuatable puncturing element cooperates with a feature in the insert such that the selectively actuatable puncturing element pierces the insert when the lid is closed after placing the insert in the housing structure, or the selectively actuatable puncturing element does not pierce the insert when the lid is closed depending upon whether the feature is present or absent in the insert.

2. A system according to claim 1 wherein the selectively actuatable puncturing element includes a weight that causes the selectively actuatable puncturing element to move from the first position to the second position during a spin cycle.

3. A system according to claim 2 wherein the selectively actuated puncturing element includes an arm having a knife at an end thereof that is pivoted to puncture a compartment of the insert during a spin cycle.

4. A system according to claim 3 wherein the system includes two of the selectively actuated puncturing elements.

5. A system according to claim 2 wherein the selectively actuatable puncturing element is operatively associated with a cam that rides in a cam track that determines the position of the element.

6. A system according to claim 5 wherein the cam track is configured such that the selectively actuatable puncturing element pivots into a position in which the puncturing element punctures the insert during a spin cycle.

7. A system according to claim 1 wherein the housing structure is positioned within the washing machine drum in a location where it will be contacted with the wash or rinse water in or being added to the drum.

8. A system according to claim 7 wherein the insert contains one compartment for wash additive material and one compartment for rinse additive material.

9. A system according to claim 8 wherein the insert contains two compartments for wash additive material and one compartment for rinse additive material.

10. A system according to claim 8 wherein the insert delivers from about 15 to 100 grams of wash additive material to at least one wash cycle and from about 5 to 50 grams of rinse additive material to at least one rinse cycle during the fabric laundering operation.

11. A system according to claim 7 wherein the housing structure is configured to retain substantially all of the contents of the opened rinse additive compartment(s) of the insert within the housing structure during the spin cycle of the laundering operation.

12. A system according to claim 11 wherein, after cessation of the spin cycle, substantially all of the contents of the opened rinse additive compartment(s) of the insert flow into the washing machine drum through holes in the housing structure.

13. A system according to claim 1 wherein the insert is rigid and constructed from thermoformed polymeric material.

14. A system according to claim 1 wherein the insert is constructed at least in part from flexible polymeric material.

15. A method for providing dispensing of laundry additive materials into the several stages of the laundering cycle which occur during the operation of an drum-containing automatic fabric laundering washing machine, which method comprises:

A) positioning a housing structure within the washing machine in a fixed spatial relationship to the washing machine drum, which housing structure comprises a base and an openable and closable lid for the base;

B) placing within the housing structure with its lid open at the beginning of the laundering operation, an insert having at least one compartment containing a laundry additive; and C) providing at least one selectively actuatable puncturing element that in conjunction with the insert controls the time at which the compartment containing the laundry additive is punctured wherein the selectively actuatable puncturing element cooperates with a feature in the insert or a such that the selectively actuatable puncturing element pierces a compartment of the insert when the lid is closed after placing the insert in the housing structure or, the selectively actuatable puncturing element does not pierce the compartments of the insert when the lid is closed depending upon whether the feature is present or absent in the insert.

16. A method according to claim 15 wherein the housing structure is positioned within the washing machine drum in a location where it will be contacted with the wash or rinse water in or being added to the drum.

17. A method according to claim 16 wherein the insert contains one compartment for wash additive material and one compartment for rinse additive material.

18. A method according to claim 16 wherein the insert contains two compartments for wash additive material and one compartment for rinse additive material.

19. A method according to claim 15 wherein the insert is rigid and constructed from thermoformed polymeric material.

20. A method according to claim 15 wherein the insert is constructed at least in part from flexible polymeric material.

21. A method according to claim 15 wherein the selectively actuatable puncturing element includes a weight that causes the selectively actuatable puncturing element to move from the first position to the second position during a spin cycle.

22. A method according to claim 21 wherein the selectively actuated puncturing element includes an arm having a knife at an end thereof that is pivoted to puncture a compartment of the insert during a spin cycle.

23. A method according to claim 22 wherein the system includes two of the selectively actuated puncturing elements.

24. A method according to claim 15 wherein the housing structure is configured to retain substantially all of the contents of the opened rinse additive compartment(s) of the insert within the housing structure during the spin cycle of the laundering operation.

25. A method according to claim 24 wherein, after cessation of the spin cycle, substantially all of the contents of the opened rinse additive compartment(s) of the insert flow into the washing machine drum through holes in the housing structure.

* * * * *